United States Patent [19]

McFarland

[11] 4,146,442

[45] Mar. 27, 1979

[54] ZINC ELECTROPLATING BATHS AND PROCESS

[75] Inventor: Charles W. McFarland, Cleveland Heights, Ohio

[73] Assignee: R. O. Hull & Company, Inc., Cleveland, Ohio

[21] Appl. No.: 904,913

[22] Filed: May 12, 1978

[51] Int. Cl.[2] ..... C25D 3/22; C25D 3/24

[52] U.S. Cl. ..... 204/55 Y; 204/55 R

[58] Field of Search ..... 204/55 R, 55 Y, 43 Z, 204/114; 106/1.29

[56] References Cited

U.S. PATENT DOCUMENTS

| | | | |
|---|---|---|---|
| 2,824,857 | 2/1958 | Drechsel | 528/378 |
| 3,393,135 | 7/1968 | Rosenberg | 204/55 Y |
| 3,838,026 | 9/1974 | Koch | 204/55 R |
| 4,075,066 | 2/1978 | Eckles et al. | 204/55 R |

*Primary Examiner*—G. L. Kaplan

*Attorney, Agent, or Firm*—Maky, Renner, Otto & Boisselle

[57] ABSTRACT

Aqueous plating baths for the electrodeposition of a zinc coating on a substrate are disclosed and comprise zinc ions to which has been added an amount, effective to provide a level and bright zinc electrodeposit, of a polymeric nitrogen-containing compound prepared by reacting a poly(alkyleneimine) with a cyclic carbonate consisting of carbon, hydrogen and oxygen atoms. More particularly, the poly(alkyleneimine) has a molecular weight within the range of from about 200 to about 100,000, and the cyclic carbonate is one wherein the ring oxygen atoms adjacent to the carbonyl grouping are each bonded to a ring carbon atom, and the ring containing the oxygen and carbon atoms has only three carbon atoms and no carbon-to-carbon unsaturation.

The aqueous plating baths of the invention may be acid zinc plating baths or alkaline cyanide or non-cyanide containing plating baths. In addition to the zinc ions and the polymeric nitrogen-containing compound, the zinc plating baths of the invention also may contain other desirable additives such as ethoxylated naphthols and aromatic carbonyl-containing compounds. Methods for the electrodeposition of level zinc deposits from such baths are disclosed.

17 Claims, No Drawings

ZINC ELECTROPLATING BATHS AND PROCESS

BACKGROUND OF THE INVENTION

This invention relates to zinc plating baths, and particularly to acid or alkaline zinc plating baths for plating bright and level zinc deposits on substrates. More particularly, the plating baths of the invention contain a polymeric nitrogen-containing compound prepared by reacting a poly(alkyleneimine) with a cyclic carbonate consisting of carbon, hydrogen and oxygen atoms.

The invention also relates to a method of electrodepositing bright zinc coatings on a substrate.

Considerable attention has been directed to the development of zinc electroplating baths which will produce bright and level zinc deposits of improved quality. Research has been devoted primarily to improving the overall brightness, the range of allowable current densities, and the ductility of the zinc deposit. The electroplating baths which have been developed are either acid zinc solutions or alkaline zinc solutions. Many of the alkaline zinc plating baths which have been suggested and used in the past contain cyanide. Because of the enactment and enforcement of various environmental protection laws, especially those designed to improve water quality, pressure on the industry has resulted in a reduction in the use of alkaline cyanide-containing plating baths.

Typically, acid zinc plating baths have been based on a suitable inorganic zinc salt such as zinc sulfate, zinc chloride, zinc fluoborate, zinc acetate, zinc sulfamate or zinc pyrophosphate. The bath usually includes a buffer such as the corresponding ammonium salt and other additives to promote an improved ductility, brightness, throwing power and covering power. Surface active agents may be included to improve the crystal structure, reduce pitting and increase the solubility of the other additives.

SUMMARY OF THE INVENTION

The present invention relates to the discovery that the performance of zinc electroplating baths, whether acid or alkaline, can be improved by adding to such baths, a brightening effective amount of a polymeric nitrogen-containing compound prepared by reacting a poly(alkyleneimine) with a cyclic carbonate consisting of carbon, hydrogen and oxygen atoms. The present invention also comprises methods for the electrodeposition of bright and level zinc deposits from acid and alkaline zinc baths.

DESCRIPTION OF THE PREFERRED EMBODIMENTS

The compositions which are useful as brightening additives for aqueous acidic and alkaline zinc electroplating baths are reaction products which are obtained by reacting a poly(alkyleneimine) with a cyclic carbonate consisting of carbon, hydrogen and oxygen atoms. A description of the preparation of examples of such reaction products is found in U.S. Pat. No. 2,824,857, which disclosure is incorporated herein by reference. The cyclic carbonates further are defined as containing ring oxygen atoms adjacent to the carbonyl grouping which are each bonded to a ring carbon atom, and the ring containing said oxygen and carbon atoms has only three carbon atoms and no carbon-to-carbon unsaturation.

The poly(alkyleneimines) which are useful in the present invention are derived from 1,2-alkyleneimines which may be represented by the general formula

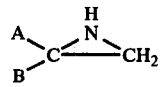

I wherein A and B may be each independently hydrogen or alkyl groups containing from one to about three carbon atoms. Where A and B are hydrogen, the compound is ethyleneimine. Compounds wherein either or both A and B are alkyl groups are referred to herein generically as alkyleneimines although such compounds have been referred to also as ethyleneimine derivatives wherein one or both hydrogens from the ethyleneimine are replaced with an alkyl group.

Examples of poly(alkyleneimines) which are useful in the present invention include polymers obtained from ethyleneimine, 1,2-propyleneimine, 1,2-butyleneimine and 1,1-dimethylethyleneimine. The poly(alkyleneimines) useful in the present invention may have molecular weights of from about 200 to about 100,000 or more although the higher molecular weight polymers are not generally as useful since they have a tendency to be insoluble to the zinc plating baths of the invention. Preferably, the molecular weight will be within the range of from about 200 to about 60,000 and more preferably from about 300 to about 2,000. Poly(ethyleneimine) having a molecular weight of from about 300 to about 2,000 is a preferred example of a poly(alkyleneimine).

The cyclic carbonates which are useful in the preparation of the polymeric nitrogen-containing compounds of the invention may be a phenylene carbonate or a cyclic carbonate represented by the following formula II

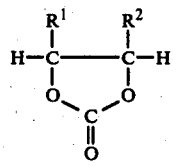

II wherein $R^1$ and $R^2$ are each independently hydrogen, alkyl, $R^3OCH_2$—wherein $R^3$ is hydrogen or a monovalent hydrocarbon radical, and $R^1$ and $R^2$ taken together may represent an alkylene radical containing at least two carbon atoms.

An example of a cyclic carbonate wherein $R^1$ and $R^2$ are hydrogen is ethylene carbonate. Propylene carbonate is an example of a cyclic carbonate wherein $R^1$ is hydrogen and $R^2$ is a methyl group. Glycerol carbonate is an example of a cyclic carbonate wherein $R^1$ is hydrogen and $R^2$ is the HO—$H_2C$— group. Other examples of cyclic carbonates useful in the preparation of the polymeric compositions of the invention include allyl glycerol carbonate; 2,3-butylene carbonate; 3,4-hexylene carbonate; butylene carbonate; and carbonates wherein $R^1$ and $R^2$ taken together represent an alkylene radical such as —$CH_2CH_2$—; —$CH_2CH_2CH_2$—; —$CH_2(CH_3)$-CH—; —$CH_2CH_2CH_2CH_2$—; —$(CH_2)_5$—, etc.

A class of cyclic carbonates which are useful in the present invention is represented by the general formula III

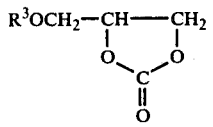

III wherein $R^3$ is hydrogen or a monovalent hydrocarbon group. Examples of monovalent hydrocarbon groups include methyl, ethyl, propyl and butyl; cyclopentyl and cyclohexyl, phenyl and tolyl groups.

The preferred examples of the cyclic carbonates are ethylene carbonate and propylene carbonate. These carbonates preferably are reacted with a poly(ethyleneimine) having a molecular weight within the range of from about 200 to about 60,000.

The reaction between the poly(alkyleneimine) and the cyclic carbonate proceeds on mixing of the two reactants. A solvent is not required, but water, alcohols and mixtures of water with alcohols often are used as diluents to facilitate the reaction. Reaction will proceed at room temperature or the mixture may be heated to accelerate the reaction. Accordingly, reaction temperatures between about 20° and 100° C. may be useful. The amount of cyclic carbonate reacted with the poly(alkyleneimine) may be varied and, in general, the molar ratio of cyclic carbonate to poly(alkyleneimine) should be sufficient to provide up to one cyclic carbonate molecule for each hydrogen bonded to a nitrogen in the poly(alkyleneimine). Preferably, the weight ratio of poly(alkyleneimine) to cyclic carbonate will vary from about 10:1 to about 10:6. Higher amounts of cyclic carbonate may result in a product which is not completely soluble in the plating baths of the invention. Reaction times of about 0.5 to about one hour at the reflux temperature of the mixture are found to be sufficient although the reaction may be conducted for lesser or greater periods of time as desired depending on the particular reactants, the solvent (if any) and other reaction parameters.

The following examples illustrate the procedure for preparing the polymeric nitrogen-containing compounds useful in the plating baths of the invention. Unless otherwise indicated, all parts and percentages are by weight.

EXAMPLE 1

A mixture of ten parts of poly(ethyleneimine) having a molecular weight of about 300 and five parts of ethylene carbonate is prepared and heated with stirring to about 100° C. for 0.5 hour. Upon cooling, the reaction product solidifies. The solid product can be dissolved in water for future use.

EXAMPLE 2

A mixture of ten parts of poly(ethyleneimine) having a molecular weight of about 1,000 and three parts of ethylene carbonate in ten parts of water is heated at the reflux temperature for about 0.5 hour.

EXAMPLE 3

The procedure of Example 2 is repeated except that 20 parts of ethylene carbonate is used in the reaction mixture.

EXAMPLE 4

The procedure of Example 2 is repeated except that the ethylene carbonate is replaced by three parts of propylene carbonate.

EXAMPLE 5

A mixture of ten parts of poly(ethyleneimine) having a molecular weight of about 1,800, 30 parts of ethanol and three parts of ethylene carbonate is prepared and heated at the reflux temperature for about 0.5 hour.

EXAMPLE 6

A mixture of ten parts of poly(ethyleneimine) having a molecular weight of about 60,000, 20 parts of water and five parts of ethylene carbonate is heated at the reflux temperature for about 0.5 hour.

EXAMPLE 7

The procedure of Example 2 is repeated except that the poly(ethyleneimine) is replaced by ten parts of a poly(1,2-propyleneimine) having a molecular weight of about 2,000.

EXAMPLE 8

The procedure of Example 2 is repeated except that the ethylene carbonate is replaced by three parts of glycerol carbonate.

The polymeric nitrogen-containing compounds of the invention which are exemplified in Examples 1–8 are useful as brightening additive compounds for aqueous alkaline and acid zinc electroplating baths. The amount of polymeric nitrogen-containing compound added to the alkaline or acid zinc electroplating baths is an amount which is effective in producing a bright and generally level deposit of zinc. Depending on the particular plating bath and the nature of the other compounds contained in the bath, the brightening effective amount of the polymeric nitrogen-containing compositions of the invention may range from about 0.01 to about as much as 15 to 20 grams per liter of bath. Presently it is not known if the above polymeric nitrogen-containing compounds retain their identities in all zinc plating baths and particularly in highly alkaline baths. In any event the polymeric compositions are effective when added to highly alkaline baths.

The efficacy of the zinc electroplating baths of the invention may be improved by including various other materials in the plating bath, and the nature of such materials will generally depend upon whether the plating bath is an acid zinc plating bath, an alkaline cyanide bath or an alkaline non-cyanide bath. Acid zinc plating baths contain free zinc ions and are prepared with zinc sulfate, zinc chloride, zinc fluoroborate and/or zinc sulphamate. The zinc plating bath normally will contain conducting salts. Examples of conducting salts include sodium chloride, sodium fluoride, ammonium chloride, ammonium fluoride, etc. The inorganic zinc salts may be present in the bath in amounts ranging from about 15 to 150 grams per liter. The conductive salts such as ammonium chloride are present in amounts ranging from about 50 to about 300 grams per liter.

The acidity of the acid baths of the invention may vary from a pH of from about 1.5 to about 6 or 7. The pH may be lowered if desired by the addition of acid solutions such as a 10% sulfuric acid solution. If the pH falls below the desired operating range, it can be increased by the addition of ammonium hydroxide or potassium hydroxide. Preferably the acid zinc baths are operated at a pH of from about 3 or 4 to about 6.5.

Alkaline zinc electroplating baths are prepared from a zinc source and an alkaline material. Sources of zinc ions for aqueous alkaline baths can be an alkaline metal zincate such as sodium zincate or potassium zincate. Other sources of zinc ions include zinc oxide, zinc sulfate, zinc acetate, etc. The alkaline material used to form the alkaline baths usually is an alkali metal hydroxide such as sodium hydroxide or potassium hydroxide. The source of cyanide in cyanide-containing baths can be zinc cyanide or sodium cyanide. The alkaline baths generally will contain from about 5 to 50 grams per liter of zinc oxide equivalent and 50 to 250 grams of a base such as sodium hydroxide. The pH of the alkaline zinc baths generally will be in the range of from about 10 to 14. The bath pH can be adjusted by the addition of sodium hydroxide.

The acid and alkaline zinc electroplating baths containing the polymeric and nitrogen-containing brightening compound of the invention may be utilized to produce bright zinc deposits on all types of metals and alloys, for example, on iron, zinc die cast, copper and brass. The electroplating baths may be employed in all types of industrial zinc plating processes including still plating baths, high-speed plating baths for strip or wire plating, and in barrel plating.

The brightness of the zinc deposited from the aqueous alkaline or acid plating baths containing a polymeric nitrogen-containing brightening compound of the invention may be improved if the bath also contains at least one aromatic carbonyl containing compound. The supplementary brighteners impart optimum leveling action over a wide plating range. The following compounds illustrate the types of aromatic carbonyl containing compounds which are useful as brighteners in the plating baths of the invention, and these carbonyl compounds include aldehydes as well as ketones: orthochlorobenzaldehyde, para-chlorobenzaldehyde, o-hydroxybenzaldehyde, aminobenzaldehyde, veratraldehyde, benzylidene acetone, coumarin, 3,4,5,6-tetrahydrobenzaldehyde, acetophenone, propiophenone, furfurylidine acetone, 3-methoxybenzal acetone, benzaldehyde, vanillin, hydroxybenzaldehyde, anisicaldehyde, benzoic acid, sodium benzoate, sodium salicylate, 3-pyridine carboxylic acid (nicotinic acid), etc. Mixtures of one or more of the aldehydes with one or more ketones also are useful. When employed in the baths of the invention, the carbonyl-containing brighteners will be included within the range of from about 0.02 to about 1 gram per liter and preferably from about 0.03 to about 0.5 gram per liter of bath.

The properties of the zinc deposited from the aqueous acidic baths of the invention may be enhanced further by including in the bath, a small amount of one or more polyoxyalkylated naphthols which are obtained by reacting a naphthol with an alkylene oxide such as ethylene oxide and propylene oxide, and more particularly, with from about 6 to about 40 moles of ethylene oxide per mole of naphthol. The naphthol reactant may be either alpha or beta naphthol and the naphthalene ring may contain various substituents such as alkyl groups or alkoxy groups, especially lower alkyl and lower alkoxy groups of up to about 7 carbon atoms each, so long as the polyoxyalkylated naphthol remains bath-soluble. When present, there usually will not be more than two such substituents per polyoxyalkylated naphthol; that is, two lower alkoxy groups, two lower alkyl groups, or a lower alkyl or a lower alkoxy group. The preferred polyoxyalkylated naphthols are ethoxylated naphthols having the formula

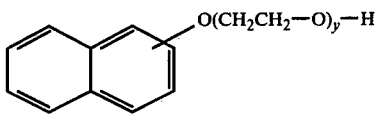

IV wherein y is from about 6 to about 40 preferably from about 8 to about 20. The amount of polyoxyalkylated naphthol included in the baths of the invention may vary within the range of from about 0.1 to about 20 grams or more per liter of bath.

In addition to the above-described polyoxyalkylated naphthols which are considered to be wetting agents, the incorporation of one or more other wetting or surface active agents into the additive composition and zinc plating baths of the invention results in a zinc plating with improved leveling and brightness, and the additive composition and plating baths exhibit improved stability.

Wetting agents based on ethylene and propylene oxide, for example, polyglycol compounds and the like, and sulfonated wetting agents also are useful at levels of about 1 to 25 g/l and preferably at about 3–5 g/l of bath. In general, the nonionic wetting agents such as those containing ether linkages are particularly useful additives. Examples of such ether-containing wetting agents are those having the general formula $$R^4—O—[(CH_2)_nO]_xH \qquad V$$

wherein $R^4$ is an aryl or alkyl group containing from about 6 to 20 carbon atoms, n is two or three, and x is an integer between 2 and 100. Such wetting agents are produced generally by treating fatty alcohols or alkyl-substituted phenols with excess ethylene oxide or propylene oxide. The alkyl carbon chain may contain from about 14 to 24 carbon atoms and may be derived from a long chain fatty alcohol such as oleyl alcohol or stearyl alcohol.

Nonionic polyoxyethylene compounds of this type, and their utility in acid zinc baths containing ammonium ions are described in U.S. Pat. No. 3,855,085. Such polyoxyethylene compounds are available commercially under the general trade designations "Surfynol" by Air Products and Chemicals, Inc. of Wayne, Pa., and under the designation "Pluronic" or "Tetronic" by BASF Wyandotte Corp. Of Wyandotte, Mich. Examples of specific polyoxyethylene condensation products useful in the invention include "Surfynol 465" which is a product obtained by reacting about 10 moles of ethylene oxide with 1 mole of tetramethyldecynediol. "Surfynol 485" is the product obtained by reacting 30 moles of ethylene oxide with tetramethyldecynediol. "Pluronic L 35" is a product obtained by reacting 22 moles of ethylene oxide with polypropylene glycol obtained by the condensation of 16 moles of propylene glycol.

Amine, long chain fatty amine, long chain fatty acid, alkanol amines, diamines, amides, alkanol amides and polyglycol-type wetting agents known in the art are also useful. One type of amine wetting agent found particularly useful in a zinc plating bath is the group obtained by the addition of a mixture of propylene oxide and ethylene oxide to diamines. More specifically, compounds formed by the addition of propylene oxide to ethylene diamine followed by the addition of ethylene oxide are useful and are available commercially from BASF Wyandotte Ind. Chemical Group under the general trade designation "Tetronic".

Carbowax-type wetting agents which are polyethylene glycols having different molecular weights have been found to give good results. For example Carbowax No. 1000 has a molecular weight range of from about 950 to 1,050 and contains from 20 to 24 ethoxy units per molecule. Carbowax No. 4000 has a molecular weight range of from about 3000 to 3700 and contains from 68 to 85 ethoxy units per molecule. Other known nonionic glycol derivatives such as polyalkylene glycol ethers and methoxy polyethylene glycols which are available commercially can be utilized as wetting agents in the compositions of the invention.

Other alkoxylated amines which are useful wetting agents are represented by the formulas VI and VII

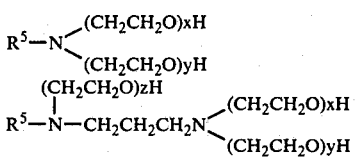

VI

VII wherein $R^5$ is a fatty alkyl group containing from 12 to 18 carbon atoms, and x, y and z are each independently integers from 1 to about 30, and the sum of x, y and z is an integer of from about 2 to about 50.

The above described alkoxylated amines are known in the art as cationic surfactants and are available from a variety of commercial sources. The brighteners of the type represented by formula VI can be prepared by condensing various amounts of ethylene oxide with primary fatty amines which may be a single amine or a mixture of amines such as are obtained by the amination of tallow oils, sperm oils, coconut oils, etc. Specific examples of fatty amines containing from 8 to 22 carbon atoms include saturated as well as unsaturated aliphatic amines such as octyl amine, decyl amine, lauryl amine, stearyl amine, oleyl amine, myristyl amine, palmityl amine, dodecyl amine, and octadecyl amine.

The alkoxylated amines which are useful in the plating baths of the invention can be prepared, as mentioned above, by condensing alkylene oxides with the above-described primary amines by techniques known to those in the art. A number of such alkoxylated amines is commercially available from a variety of sources. The alkoxylated amines of the type represented by formula VI are available from the Armak Chemical Division of Akzona, Inc., Chicago, Ill., under the general trade designation "Ethomeen". Specific examples of such products include "Ethomeen C/15" which is an ethylene oxide condensate of a coconut fatty amine containing about 5 moles of ethylene oxide; "Ethomeen C/20" and "C/25" which also are ethylene oxide condensation products from coconut fatty amine containing about 10 and 15 moles of ethylene oxide respectively; "Ethomeen S/15" and "S/20" which are ethylene oxide condensation products with stearyl amine containing about 5 and 10 moles of ethylene oxide per mole of amine respectively; and "Ethomeen T/15" and "T/25" which are ethylene oxide condensation products of tallow amine containing about 5 and 15 moles of ethylene oxide per mole of amine respectively. Commercially available examples of the alkoxylated amines of the type represented by formula VII include "Ethoduomeen T/13" and "T/20" which are ethylene oxide condensation products of N-tallow trimethylene diamine containing about 3 and 10 moles of ethylene oxide per mole of diamine respectively.

Other conventional additives may be included in the acid and alkaline zinc electroplating baths of the invention to improve the overall performance thereof. Examples of other conventional additives include gelatin, peptone, substituted -N-alkyl pyridinium halides and quaternized aliphatic amines.

The plating baths of the invention will deposit a bright, level and ductile zinc deposit on substrates at any conventional temperature such as from about 20° to about 60° C. and, more preferably, from about 20° to about 35° C.

The following examples illustrate the aqueous zinc electroplating baths of the invention.

| | | |
|---|---|---|
| Example A | | |
| | Zinc chloride | 28 g/l |
| | Ammonium chloride | 204 g/l |
| | Product of Example 2 | 35 ml/l |
| | ph | 6.5 |
| Example B | | |
| | Zinc chloride | 28 g/l |
| | Ammonium chloride | 204 g/l |
| | Ethoxylated 2-naphthol | 3.9 g/l |
| | Product of Example 2 | 8.4 g/l |
| | Benzylidene acetone | 0.13 g/l |
| Example C | | |
| | Zinc sulfate | 34 g/l |
| | Ammonium chloride | 150 g/l |
| | Product of Example 4 | 30 ml./l |
| | ph | 5.5 |
| Example D | | |
| | Zinc ions(from zinc oxide) | 34 g/l |
| | Sodium hydroxide | 77 g/l |
| | Sodium cyanide | 96 g/l |
| | Product of Example 2 | 35 ml/l |
| Example E | | |
| | Zinc ions(from zinc oxide) | 34 g/l |
| | Sodium hydroxide | 77 g/l |
| | Sodium cyanide | 96 g/l |
| | Product of Example 2 | 0.16 g/l |
| | Polyvinyl alcohol | 0.03 g/l |
| | Dimethylaminopropylamine-epichlorohydrin polymer | 0.013 g/l |
| | Benzylated nicotinic acid | 0.2 g/l |
| | Manganese sulfate | 0.006 g/l |
| Example F | | |
| | Zinc ions | 7.6 g/l |
| | Sodium hydroxide | 77 g/l |
| | Sodium carbonate | 23 g/l |
| | Tartaric acid | 3.5 g/l |
| | Product of Example 2 | 35 ml/l |
| Example G | | |
| | Zinc ions | 7.6 g/l |
| | Sodium hydroxide | 77 g/l |
| | Sodium carbonate | 23 g/l |
| | Tartaric acid | 3.5 g/l |
| | Product of Example 2 | 20 ml/l |
| | Veratraldehyde bisulfite (2% solution) | 4 ml/l |
| Example H | | |
| | Zinc chloride | 28 g/l |
| | Ammonium chloride | 204 g/l |
| | Product of Example 1 | 12 g/l |
| | pH | 6.5 |
| Example I | | |
| | Zinc chloride | 28 g/l |
| | Ammonium chloride | 204 g/l |
| | Product of Example 3 | 12 g/l* |
| Example J | | |
| | Zinc chloride | 28 g/l |
| | Ammonium chloride | 204 g/l |
| | Product of Example 4 | 12 g/l* |
| Example K | | |
| | Zinc chloride | 28 g/l |
| | Ammonium chloride | 204 g/l |
| | Product of Example 5 | 12 g/l* |

*In Examples I,J and K, the amount indicated is the amount of active reaction product.

The efficacy of the above plating baths is determined by conducting plating tests in a 267 ml. Hull Cell at an operating current as indicated below for the times indicated. The plating bath of Example A is found to provide a smooth, fairly bright deposit from 0 to more than 15 amps/sq.dm. although there is a white cloudy low-current band from 0 to 1 amp/sq.dm. The plating bath of Example B containing other ingredients results in a uniformly brilliant deposit. The plating bath of Example D gives a clear, reasonably bright deposit up to about 2 amps/sq.dm. whereas the plating bath of Example E provides a commercially acceptable brilliant deposit over a wide current density range. The product of Example F provides a uniform bright deposit up to about 10 amps/sq.dm. whereas the plating bath of Example G provides a bright deposit over an extended current density range in view of the presence of the other additives. The plating baths prepared in Examples H–K, tested in a Hull Cell at an operating current of 3 amperes for 2.5 minutes provide satisfactory bright zinc deposits.

The plating baths of the invention may be operated on a continuous or intermittent basis, and from time to time, the components of the bath may have to be replenished. The various components may be added singularly as required or may be added in combination. The amounts of the various compositions to be added to the plating baths may be varied over a wide range depending on the nature and performance of the zinc plating bath to which the composition is added. Such amounts can be determined readily by one skilled in the art.

The embodiments of the invention in which an exclusive property or privilege is claimed are defined as follows:

1. An aqueous alkaline or acid zinc plating bath comprising zinc ions to which has been added a brightening effective amount of a polymeric nitrogen-containing compound prepared by reacting a poly(alkyleneimine) with a cyclic carbonate consisting of carbon, hydrogen, and oxygen atoms.

2. The zinc plating bath of claim 1 wherein the cyclic carbonate contains ring oxygen atoms adjacent to the carbonyl grouping which are each bonded to a ring carbon atom, the ring containing said oxygen and said carbon atoms having only three carbon atoms and no carbon-to-carbon unsaturation.

3. The zinc plating bath of claim 1 wherein the cyclic carbonate used in the preparation of the polymeric nitrogen-containing compound is phenylene carbonate or a cyclic carbonate having the general formula

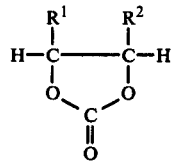

II wherein $R^1$ and $R_2$ are each independently hydrogen, alkyl, $R^3OCH_2$— wherein $R^3$ is hydrogen or a monovalent hydrocarbon radical, and $R^1$ and $R^2$ taken together may represent an alkylene radical containing at least two carbon atoms.

4. The zinc plating bath of claim 1 wherein the polymeric nitrogen-containing compound is prepared by reacting the poly(alkyleneimine) with the cyclic carbonate at a temperature between about 20° and 100° C.

5. The zinc plating bath of claim 1 wherein the poly(alkyleneimine) used to form the polymeric nitrogen-containing compound is a poly(ethyleneimine) having a molecular weight of between about 200 and about 100,000.

6. The zinc plating bath of claim 5 wherein, the maximum amount of cyclic carbonate reacted with the poly(ethyleneimine) is an amount sufficient to provide up to one cyclic carbonate molecule for each hydrogen bonded to nitrogen in the poly(ethyleneimine).

7. The zinc plating bath of claim 6 wherein the cyclic carbonate is ethylene or propylene carbonate.

8. The zinc plating bath of claim 6 wherein the molecular weight of the poly(ethyleneimine) is from about 300 to about 60,000.

9. The zinc plating bath of claim 1 wherein the polymeric nitrogen-containing compound is prepared by the rection of a poly(alkyleneimine) with a cyclic carbonate in the presence of water, an alcohol or mixtures thereof.

10. The zinc plating bath of claim 1 wherein the plating bath is an acid zinc bath comprising zinc ions, chloride ions and ammonium ions.

11. The plating bath of claim 10 wherein the acid zinc bath also contains at least one polyoxyalkylated naphthol.

12. The plating bath of claim 1 wherein the bath is an aqueous alkaline cyanide or non-cyanide zinc plating bath.

13. The zinc plating bath of claim 1 wherein the polymeric nitrogen-containing compound is prepared by reacting about 10 parts of a poly(ethyleneimine) having a molecular weight of from about 300 to about 2,000 with about one to six parts of ethylene or propylene carbonate.

14. The plating bath of claim 1 wherein the bath also contains an aromatic carbonyl-containing compound.

15. An aqueous alkaline zinc plating bath according to any one of claims 1-9, 13 or 14.

16. An aqueous acidic zinc plating bath according to any one of claims 1-9, 13 or 14.

17. A method of electrodepositing a zinc coating on a substrate which comprises electroplating said substrate with a zinc plating bath according to any one of claims 1 through 14.

* * * * *